US007334861B2

(12) United States Patent
Ha

(10) Patent No.: US 7,334,861 B2
(45) Date of Patent: Feb. 26, 2008

(54) INKJET IMAGE FORMING APPARATUS

(75) Inventor: Dong-woo Ha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 411 days.

(21) Appl. No.: 11/166,652

(22) Filed: Jun. 27, 2005

(65) Prior Publication Data

US 2006/0119671 A1 Jun. 8, 2006

(30) Foreign Application Priority Data

Dec. 7, 2004 (KR) ..... 10-2004-0102309

(51) Int. Cl.
*B41J 2/195* (2006.01)
*B41J 29/393* (2006.01)
*B41J 2/175* (2006.01)

(52) U.S. Cl. ..... 347/19; 347/7; 347/85

(58) Field of Classification Search ..... 347/7, 347/19, 85, 108; 141/2, 18
See application file for complete search history.

(56) References Cited

U.S. PATENT DOCUMENTS 6,065,831 A * 5/2000 Kawaura et al. ..... 347/108
6,739,692 B2 * 5/2004 Unosawa ..... 347/22
6,893,118 B2 * 5/2005 Murakami et al. ..... 347/84
6,969,169 B2 * 11/2005 Tanaami et al. ..... 347/108
7,029,105 B2 * 4/2006 Matsuba et al. ..... 347/86

FOREIGN PATENT DOCUMENTS

| | | |
|---|---|---|
| JP | 10-058791 | 3/1998 |
| JP | 11-058768 | 3/1999 |
| JP | 2003-127416 | 5/2003 |
| JP | 2004-066506 | 3/2004 |
| JP | 2004-066835 | 3/2004 |
| JP | 2004-098466 | 4/2004 |

* cited by examiner

*Primary Examiner*—Anh T. N. Vo
(74) *Attorney, Agent, or Firm*—Roylance, Abrams, Berdo & Goodman, L.L.P.

(57) ABSTRACT

An inkjet image forming apparatus is provided. The image forming apparatus includes an inkjet printhead that prints an image by ejecting ink on paper and has an ink refill hole through which the inkjet printhead is refillable with ink. A cover is disposed over the ink refill hole. A door covers part of a housing when closed and exposes the covered part of the housing when opened so that the inkjet printhead is accessible. A sensor detects whether the door is open or closed and outputs a door open signal or a door closed signal based on the detection results. An electrical actuator is coupled to the cover and lifts up or down the cover in response to the door open signal or the door closed signal.

20 Claims, 6 Drawing Sheets

INKJET IMAGE FORMING APPARATUS

CROSS REFERENCE TO RELATED APPLICATION

This application claims the benefit under 35 U.S.C. § 119(a) of Korean Patent Application No. 10-2004-0102309, filed on Dec. 7, 2004, in the Korean Intellectual Property Office, the entire disclosure of which is hereby incorporated by reference.

BACKGROUND OF THE INVENTION

1. Field of the Invention

The present invention relates to an inkjet image forming apparatus. More particularly, the present invention relates to an inkjet image forming apparatus having an inkjet printhead that is refillable with ink.

2. Description of the Related Art

When ink contained in an inkjet printhead is used up, the inkjet printhead is replaced with a new inkjet printhead or is refilled with ink. An inkjet image forming apparatus includes an ink residual quantity detection unit, which detects the amount of ink remaining in an inkjet printhead. It is necessary to precisely detect the exact amount of ink remaining in the inkjet printhead to inform a user that the inkjet printhead needs to be replaced with a new inkjet printhead or needs to be refilled with ink. In a case where the inkjet printhead is refilled with ink with the image forming apparatus turned on, the ink residual quantity detection unit can recognize that the inkjet printhead has been refilled with ink. However, if the inkjet printhead is refilled with ink with the image forming apparatus turned off, the ink residual quantity detection unit cannot determine whether the inkjet printhead has been refilled with ink, in which case, the ink residual quantity detection unit may have imprecise information on the amount of ink remaining in the inkjet printhead.

Accordingly, a need exists for an image forming apparatus having a refillable inkjet printhead that substantially avoids refilling of the inkjet printhead when the image forming apparatus is turned off.

SUMMARY OF THE INVENTION

Embodiments of the present invention provide an inkjet image forming apparatus that substantially avoids refilling of an inkjet printhead with ink when the image forming apparatus is turned off.

According to an aspect of the present invention, an inkjet image forming apparatus includes an inkjet printhead that prints an image by ejecting ink on paper and has an ink refill hole through which the inkjet printhead is refillable with ink. A cover is disposed over the ink refill hole. A door covers part of a housing when closed and exposes the covered part of the housing when opened so that the inkjet printhead is accessible. A sensor detects whether the door is open or closed and outputs a door open signal or a door closed signal based on the detection results. An electrical actuator is coupled to the cover and lifts the cover up or down in response to the door open or closed signal.

The actuator may include a solenoid that is driven in response to the door open or closed signal.

The actuator may include a DC motor that lifts the cover up or down by rotating in a forward direction or a backward direction in response to the door open or closed signal.

The cover may rotate to open or close the ink refill hole. The inkjet image forming apparatus may also include a pinion gear that is coupled to a rotation shaft of the cover, and a worm gear that is coupled to a rotation shaft of the DC motor and engages the pinion gear to rotate the pinion gear.

The inkjet printhead may be a line printing-type inkjet head and preferably includes a nozzle unit that is approximately as wide as the width of the printing medium.

The inkjet printhead may also be a shuttle-type inkjet head that prints an image on the paper by reciprocating in a direction perpendicular to a direction in which the paper is transferred. Here, the cover is connected to the actuator when placed in a service station.

Other objects, advantages and salient features of the present invention will become apparent from the following detailed description, which, taken in conjunction with the annexed drawings, discloses exemplary embodiments of the present invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

The present invention will now be described more fully with reference to the accompanying drawings in which exemplary embodiments of the invention are shown.

Figure 1:
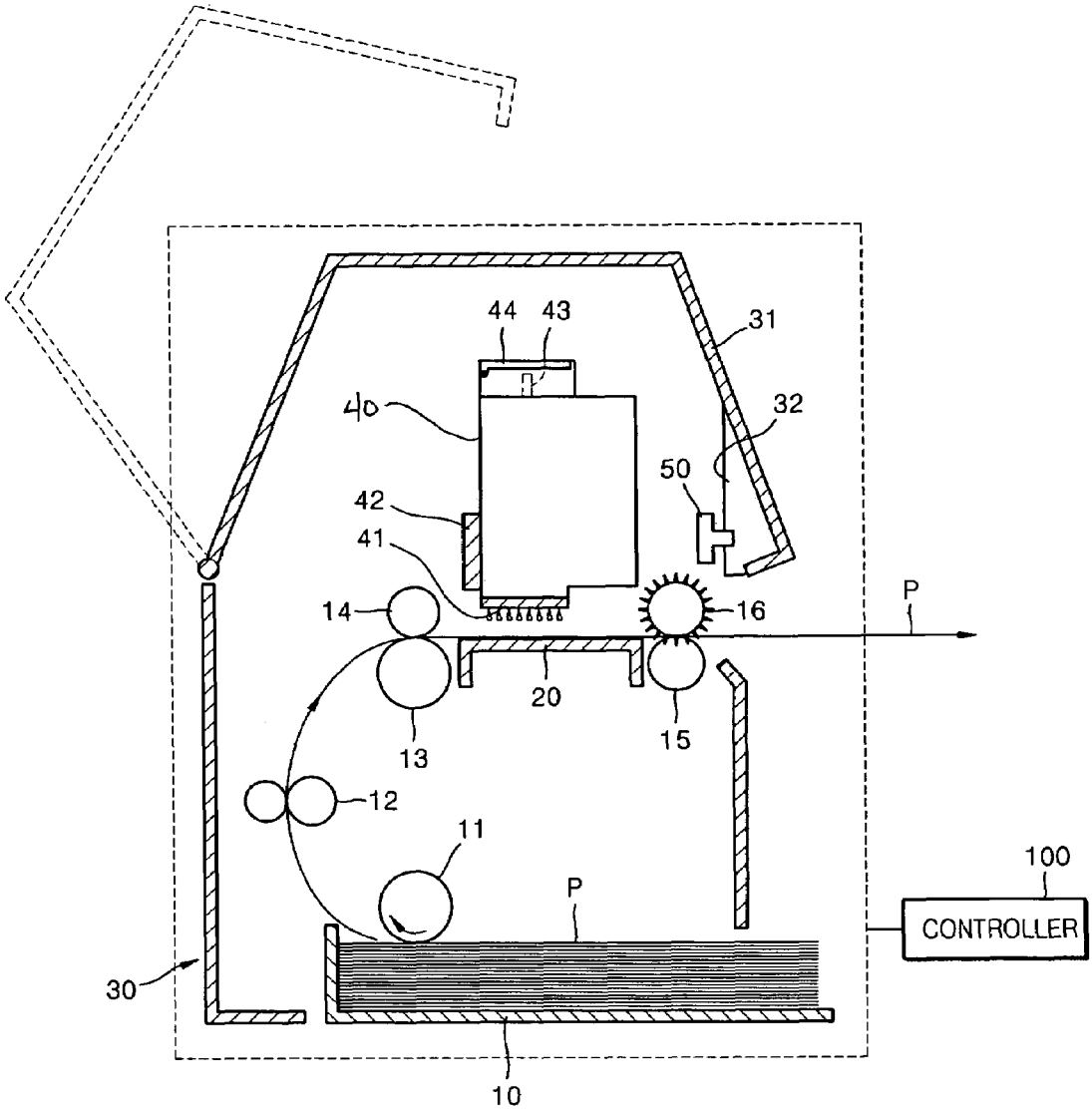
FIG. 1 is a perspective view of an inkjet image forming apparatus according to an exemplary embodiment of the present invention.
Figure 2:
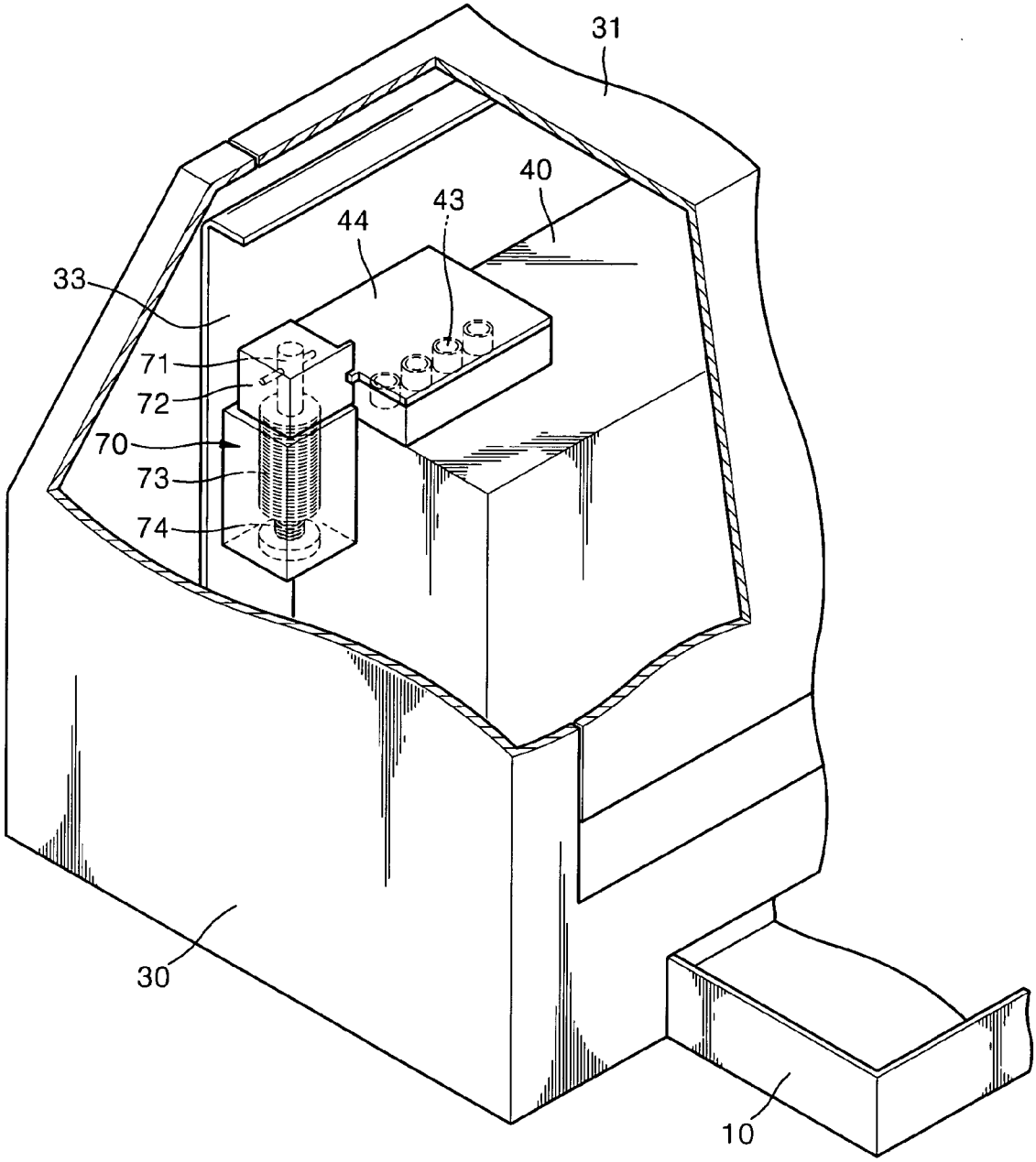
FIG. 2 is a perspective view of the inkjet image forming apparatus with a cover disposed over an ink refill hole.

FIGS. 1 and 2 are perspective views illustrating an inkjet image forming apparatus according to an exemplary embodiment of the present invention. Referring to FIGS. 1 and 2, the inkjet image forming apparatus includes a cassette 10, in which paper P is loaded, a pickup roller 11 that picks up the paper P from the cassette 10, and a feed roller 13 and a slave roller 14 that are geared together to rotate and transfer the paper P at a predetermined speed. The inkjet image forming apparatus also includes a drive roller 12, which is located between the pickup roller 11 and the feed roller 13 and assists the transfer of the paper P. An inkjet printhead 40 is preferably a line printing-type inkjet head and includes a nozzle unit 41 whose length is approximately as wide as the width of the printing medium P, such as paper. This type of inkjet printhead 40 does not reciprocate in a direction perpendicular to a direction in which paper is transferred. The inkjet printhead 40 ejects ink on the paper P at a fixed location 20 and prints an image on the paper P. The paper P is discharged by a discharging roller 15 and a star wheel 16. A door 31 is rotatably coupled to a housing 30. The door 31 covers part of the housing 30 when closed (shown in solid lines in FIG. 1) and exposes it when opened (shown in broken lines in FIG. 1). The housing 30 forms an exterior surface of the inkjet image forming apparatus. The inkjet printhead 40 includes an ink residual quantity detection unit 42. The inkjet residual quantity detection unit 42 detects the amount of ink remaining in the inkjet printhead 40 by, for example, counting how many times N ink has been ejected from the inkjet printhead 40. In other words, supposing that Qi represents the amount of ink contained in the inkjet printhead 40 at the very beginning of use of the inkjet printhead 40 and q represents the amount of ink ejected by the inkjet printhead 40 per one ejection action, the amount of ink remaining in the inkjet printhead 40 is substantially equal to Qi−qN.

The inkjet printhead 40 includes at least one ink refill hole 43 through which the inkjet printhead 40 is refillable with ink, and a cover 44 that is disposed over the ink refill hole 43. The cover 44 is movably coupled to the inkjet printhead 40 and thus opens or shuts the ink refill hole 43. In the present exemplary embodiment, it is detected whether the door 31 is open or closed, and then it is determined whether to lift the cover 44 based on the detection results. The inkjet image forming apparatus may also include a sensor that detects whether the door 31 is open or closed, and an actuator that moves up or down the cover 44 in response to an electrical signal output from the sensor to indicate whether the door 31 is open or closed. Specifically, the sensor determines whether the door 31 is open or closed and outputs an electrical signal, i.e., a door open signal or a door closed signal, based on the determination results. In an exemplary embodiment of the present invention, an optical sensor 50 is used as the sensor. The optical sensor 50 outputs the door closed signal or the door open signal based on whether the optical sensor 50 detects a light shield 32 provided on the door 31.

In an exemplary embodiment of the present embodiment, a solenoid 70 is used as the actuator. A bracket 72 is rotatably coupled to a driving axial member 71 of the solenoid 70. Additionally, the bracket 72 is connected to the cover 44. The inkjet printhead 40 is coupled to a frame 33. The solenoid 70 is installed on the frame 33. The solenoid 70 may be installed on the inkjet printhead 40. A controller 100 switches an electric current supplied to a coil 73 of the solenoid 70 in response to the electrical signal output from the sensor 50.

The operation of the inkjet image forming apparatus will now be described in detail with reference to FIG. 3.

Figure 3:
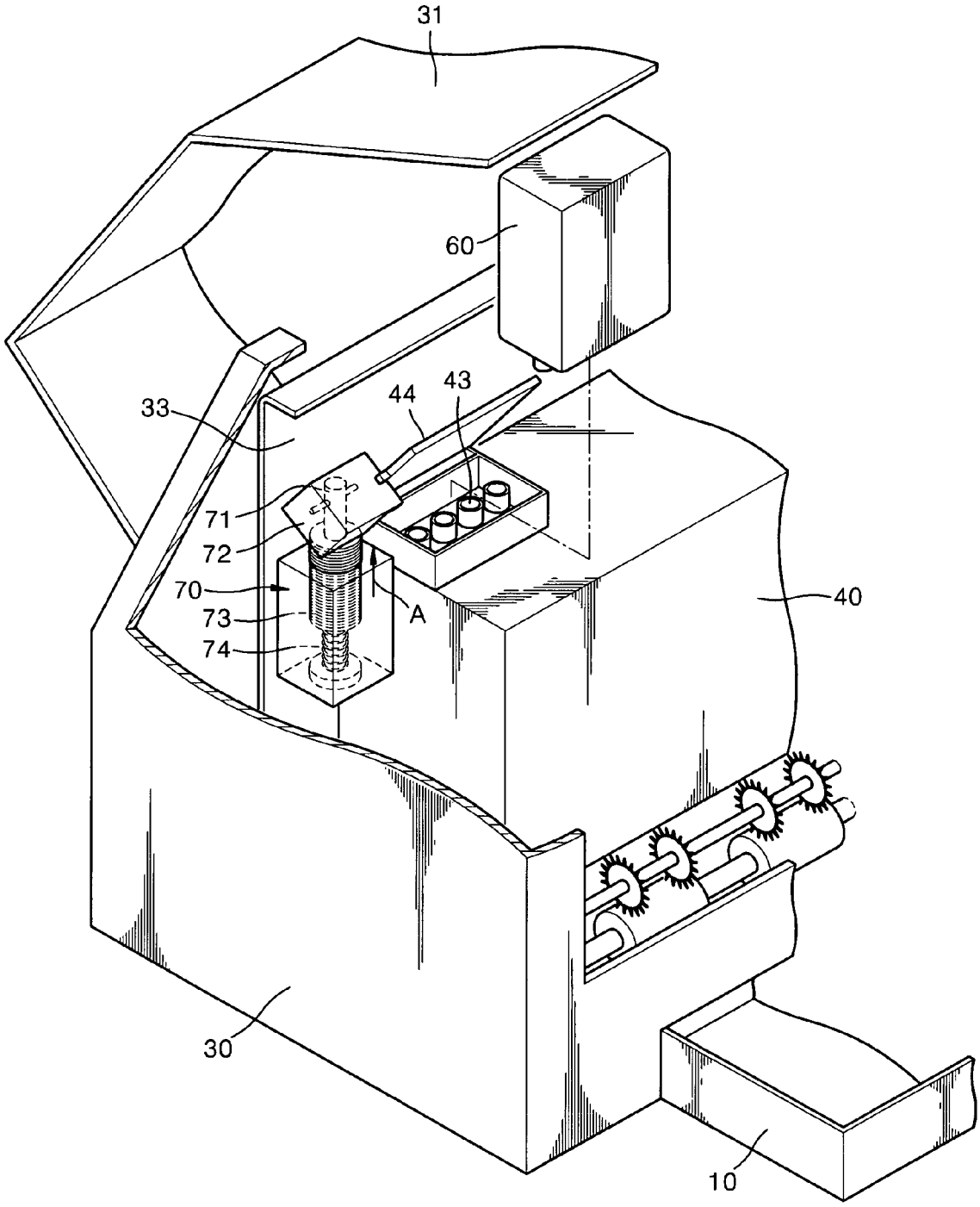
FIG. 3 is a perspective view of the inkjet image forming apparatus with the cover lifted.

Referring to FIG. 3, if a user opens the door 31 with the inkjet image forming apparatus turned on, the sensor 50 outputs a door open signal to the controller 100. Then, the controller 100 supplies a current to the coil 73 in the solenoid 70 so that an electromagnetic force is generated by the coil 73. Accordingly, the driving axial member 71 of the solenoid 70 moves in a direction A, thereby lifting the cover 44 upwardly. Thereafter, the user fits an opening of an ink tank 60 into the ink refill hole 43 so that ink contained in the ink tank 60 pours into the inkjet printhead 40 through the ink refill hole 43. When the refilling of the inkjet printhead 40 with ink is complete, the user separates the ink tank 60 from the ink refill hole 43 and then shuts the door 31. Then, the sensor 50 outputs a door closed signal to the controller 100. The controller 100 cuts off the current supplied to the coil 73 in the solenoid 70 so that the driving axial member 71 of the solenoid 70 returns to its original location with the aid of a return spring 74. Accordingly, the cover 44 is moved downwardly.

Figure 4:
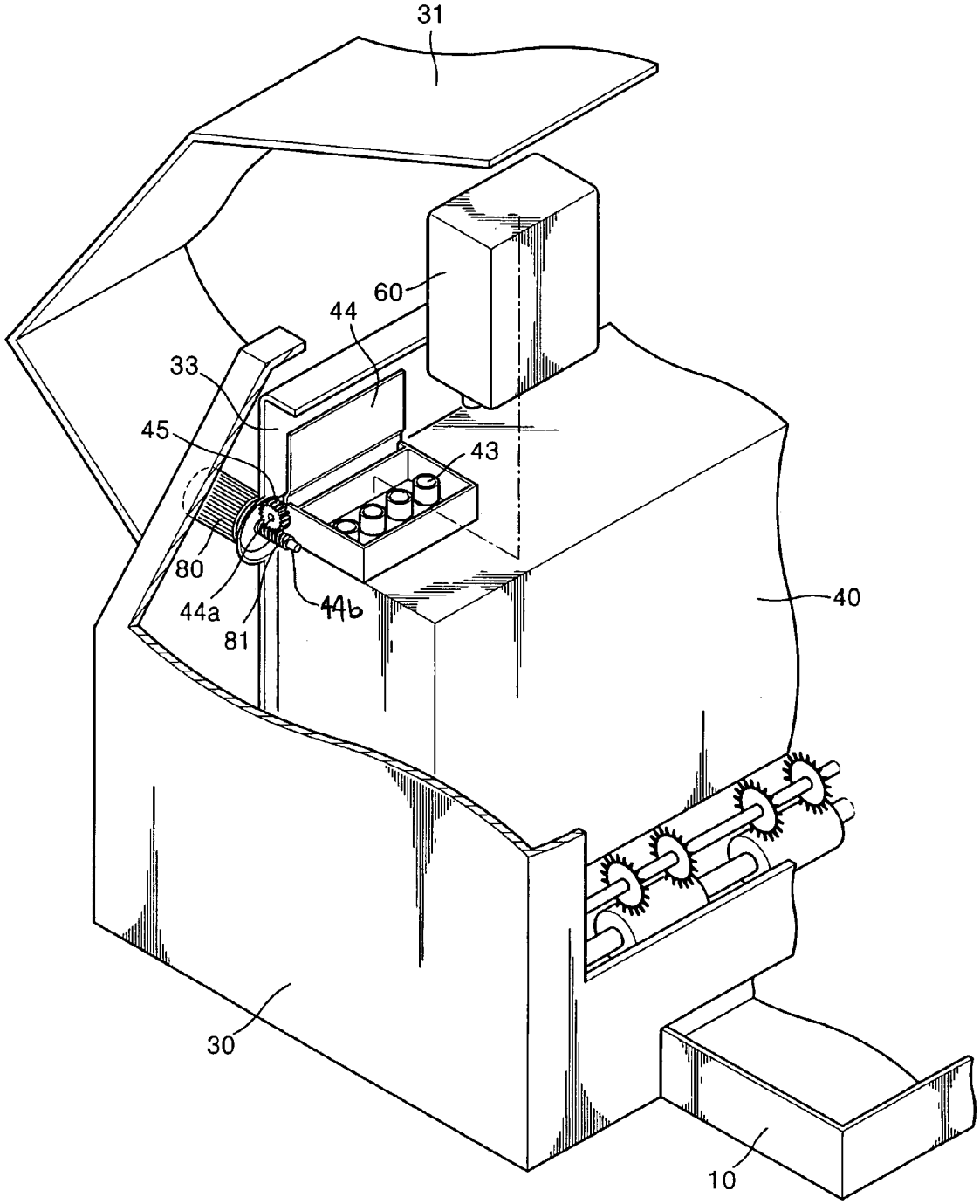
FIG. 4 is a perspective view of an inkjet image forming apparatus according to another exemplary embodiment of the present invention.

FIG. 4 is a perspective view of an inkjet image forming apparatus according to another exemplary embodiment of the present invention. Referring to FIG. 4, the inkjet image forming apparatus uses a direct current (DC) motor 80 as an actuator. A worm gear 81 is coupled to a rotation shaft **44*b* of the DC motor 80. A cover 44 is rotatably coupled to an inkjet printhead 40. A pinion gear 45, which engages the worm gear 81, is coupled to the rotation shaft 44*a* of the cover 44. A controller 100 rotates the DC motor 80 in a forward or backward direction in response to a door open signal or a door closed signal output from an optical sensor 50 (FIG. 1**).

If a user opens a door 31 with the inkjet image forming apparatus turned on, the optical sensor 50 outputs a door open signal to the controller 100, and then the controller 100 rotates the DC motor 80 in a forward direction in response to the door open signal to lift up the cover 44. When the cover 44 is lifted up, the user fits an opening of an ink tank 60 into an ink refill hole 43 of the inkjet printhead 40 so that ink contained in the ink tank 60 pours into the inkjet printhead 40 through the ink refill hole 43. When the refilling of the inkjet printhead 40 with ink is complete, the user separates the ink tank 60 from the ink refill hole 43 and then shuts the door 31. Then, the optical sensor 50 outputs a door closed signal to the controller 100. Thereafter, the controller 100 rotates the DC motor 80 in a backward direction to lower the cover 44 downwardly. In an exemplary embodiment, when the inkjet image forming apparatus is turned off, it is extremely difficult to lift up the cover 44 without breaking the DC motor 80 down.

In short, in the inkjet image forming apparatus of FIGS. 1, 2, 3 and 4, the cover 44 is lifted up or down by an electrical actuator which is driven in response to a door open signal or a door closed signal. Thus, it is extremely difficult to lift up the cover 44 and to refill the inkjet printhead 40 with ink when the inkjet image forming apparatus of FIGS. 1,2,3, and 4 is turned off. Accordingly, the problem of a conventional inkjet image forming apparatus being misled about the amount of ink remaining in an inkjet printhead is avoided since ink is not refilled while the image forming apparatus is turned off.

Figure 5:
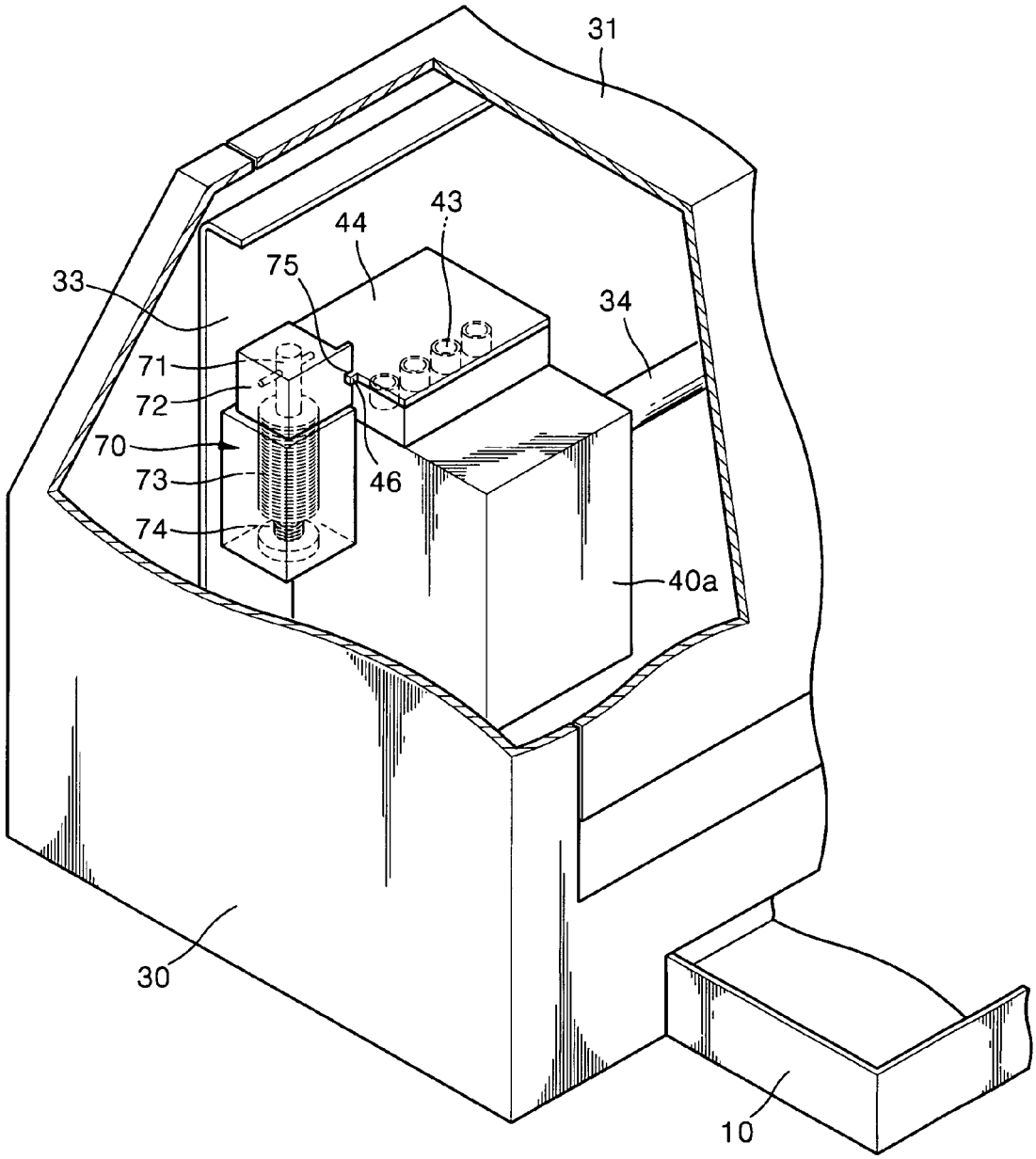
FIG. 5 is a perspective view of an inkjet image forming apparatus according to another exemplary embodiment of the present invention.

Embodiments of the present invention have been described above as being applicable to an inkjet image forming apparatus having an inkjet head that uses a line printing method. However, the present invention is also applicable to an inkjet image forming apparatus having a shuttle-type inkjet printhead. Referring to FIG. 5, a shuttle-type inkjet printhead **40*a* prints an image on paper while reciprocating along a shaft 34 in a direction perpendicular to a direction in which the paper P is transferred. A solenoid is installed on a frame 33. The shuttle-type inkjet printhead 40*a* is placed in a service station when not performing a printing operation. When the shuttle-type inkjet printhead 40*a* is placed in the service station, a protrusion 46 of a cover 44 is inserted into a groove 75 formed in a bracket 72. Thus, the cover 44 is lifted up or down by the solenoid 70. When a DC motor is used instead of the solenoid 70, a worm gear 81 engages a pinion gear 45 when the shuttle-type inkjet head 40 is placed in the service station. Thus, the cover 44** is lifted up or down by the DC motor.

Figure 6:
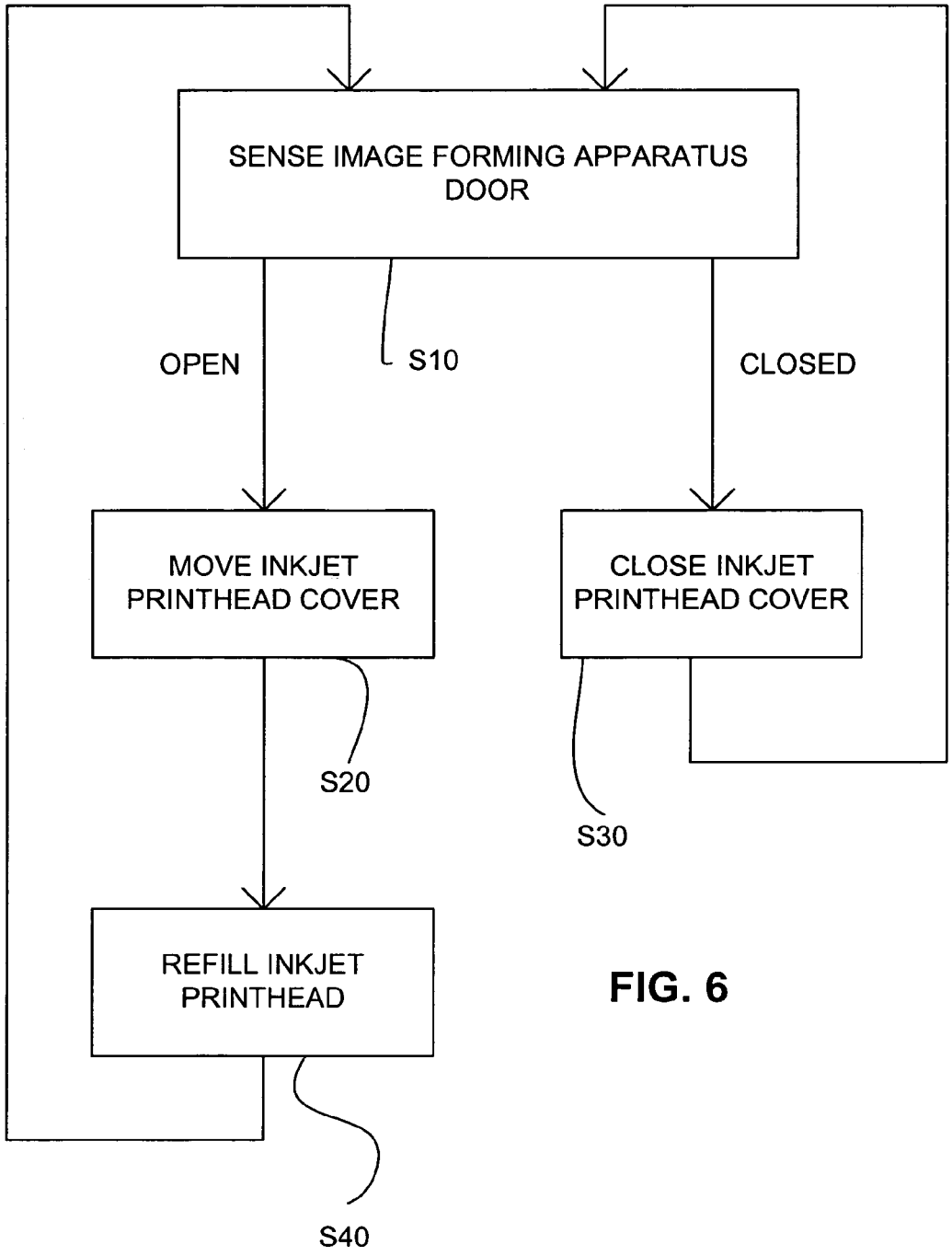
FIG. 6 is a flowchart illustrating refilling an inkjet printhead of a powered on image forming apparatus according to exemplary embodiments of the present invention.

As described above, the inkjet image forming apparatus according to exemplary embodiments of the present invention lifts up or down a cover that is disposed over an ink refill hole of an inkjet printhead using an electrical actuator that is driven in accordance with the opening or shutting of a door. Accordingly, the inkjet image forming apparatus according to exemplary embodiments of the present invention prevents refilling of the inkjet printhead with ink when turned off. A method of refilling an inkjet printhead of a powered on image forming apparatus is shown in FIG. 6. A first step, S10, includes sensing whether a door that provides access to the inkjet printhead is in an open or closed position. A cover of the inkjet printhead is moved with an electrical actuator to provide access to an ink refill hole in the inkjet printhead when the door is sensed to be in the open position (step S20) and the cover of the inkjet printhead is moved with the electrical actuator to block access to the ink refill hole in the inkjet printhead when the door is sensed to be in the closed position (step S30). The inkjet printhead is refilled with ink when the cover is in the open position (step S40). Once the inkjet printhead has been refilled, the door is closed. When the door is sensed to be in the closed position (step S10), a signal is sent to close the inkjet printhead cover (step S30).

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An inkjet image forming apparatus, comprising:

an inkjet printhead that prints an image by ejecting ink on a paper and has an ink refill hole through which the inkjet printhead is refillable with ink;

a cover that is disposed over the ink refill hole;

a door that covers a part of a housing when closed and exposes the covered part of the housing when opened so that the inkjet printhead is accessible;

a sensor that detects whether the door is open or closed and outputs a door open signal or a door closed signal based on detection results; and an electrical actuator coupled to the cover to move up or down the cover in response to the door open signal or the door closed signal.

2. The inkjet image forming apparatus of claim 1, wherein the actuator includes a solenoid that is driven in response to the door open signal or the door closed signal.

3. The inkjet image forming apparatus of claim 2, wherein a magnetic coil of a solenoid generates an electromagnetic force in response to current received from the controller to lift the cover.

4. The inkjet image forming apparatus of claim 3, wherein an axial member moves upwardly in response to the generated electromagnetic force to lift the cover.

5. The inkjet image forming apparatus of claim 1, wherein a controller receives the signal from the sensor and in response thereto supplies current to drive the actuator.

6. The inkjet image forming apparatus of claim 1, wherein a spring is connected to the axial member to facilitate returning the axial member to its original position when no electromagnetic force is being generated.

7. The inkjet image forming apparatus of claim 1, wherein the actuator includes a DC motor that lifts up or down the cover by rotating in a forward direction or a backward direction in response to the door open signal or the door closed signal.

8. The inkjet image forming apparatus of claim 7, wherein the cover rotates to open or close the ink refill hole;

a pinion gear is coupled to a rotation shaft of the cover; and a worm gear is coupled to a rotation shaft of the DC motor and engages the pinion gear to rotate the pinion gear.

9. The inkjet image forming apparatus of claim 1, wherein the inkjet printhead is a line printing-type inkjet head and has a nozzle unit that is as wide as the width of the paper.

10. The inkjet image forming apparatus of claim 1, wherein the inkjet printhead is a shuttle-type inkjet head that prints an image on the paper while reciprocating in a direction perpendicular to a direction in which the paper is transferred, the cover being connected to the actuator when placed in a service station.

11. The inkjet image forming apparatus of claim 1, wherein the sensor is an optical sensor.

12. The inkjet image forming apparatus of claim 11, wherein the optical sensor senses a light shield disposed on the door.

13. A method of refilling an inkjet printhead of a powered on image forming apparatus, comprising the steps of sensing whether a door providing access to the inkjet printhead is in an open or closed position; and moving a cover of the inkjet printhead with an electrical actuator to provide access to an ink refill hole in the inkjet printhead when the door is sensed to be in the open position and moving the cover of the inkjet printhead with the electrical actuator to block access to the ink refill hole in the inkjet printhead when the door is sensed to be in the closed position.

14. A method of refilling an inkjet printhead according to claim 13, further comprising sensing a light shield disposed on the door with the sensor.

15. A method of refilling an inkjet printhead according to claim 13, further comprising sending a signal to a controller indicating the position of the door.

16. A method of refilling an inkjet printhead according to claim 15, further comprising supplying current to the electrical actuator from the controller to move the cover in response to the position of the door.

17. A method of refilling an inkjet printhead according to claim 16, further comprising generating an electromagnetic field with an electrical coil of a solenoid of the electrical actuator with the supplied current;

moving an axial member of the electrical actuator upwardly in response to the generated electromagnetic field; and opening the cover in response to the movement of the axial member.

18. A method of refilling an inkjet printhead according to claim 17, further comprising moving the axial member downwardly when generation of the electromagnetic field is stopped.

19. A method of refilling an inkjet printhead according to claim 18, further comprising biasing the axial member downwardly with a spring.

20. A method of refilling an inkjet printhead according to claim 16, further comprising rotating a worm gear of a motor in response to the supplied current; and rotating a pinion gear of a shaft of the cover in response to the rotation of the worm gear to open or close the cover.

* * * * *